United States Patent [19]

Seaberg

[11] Patent Number: 4,752,179

[45] Date of Patent: Jun. 21, 1988

[54] PUSH-PULL LOAD HANDLER FOR FORKLIFT TRUCK

[75] Inventor: Richard D. Seaberg, Vancouver, Wash.

[73] Assignee: Cascade Corporation, Portland, Oreg.

[21] Appl. No.: 7,742

[22] Filed: Jan. 27, 1987

[51] Int. Cl.[4] ..... B66F 9/06

[52] U.S. Cl. ..... 414/607; 414/280; 414/493; 414/661; 414/667; 414/671; 414/785; 187/9 R

[58] Field of Search ..... 414/607, 608, 277, 280, 414/281, 282, 491, 492, 493, 498, 495, 497, 661, 659, 667, 671, 668, 785; 187/9 R, 9 E

[56] References Cited

U.S. PATENT DOCUMENTS

| | | | |
|---|---|---|---|
| 3,460,700 | 8/1969 | Kroupa . | |
| 3,516,641 | 6/1970 | Ferguson | 414/661 X |
| 3,640,414 | 2/1972 | Brudi . | |
| 3,819,078 | 6/1974 | Walsh | 414/671 |
| 3,822,803 | 7/1974 | Thompson | 414/607 |
| 3,885,692 | 5/1975 | Anderson Jr. . | |
| 4,065,012 | 12/1977 | Rocco . | |
| 4,165,008 | 8/1979 | Faust et al. | 414/667 X |
| 4,482,286 | 11/1984 | Farmer et al. . | |
| 4,607,997 | 8/1986 | Asano | 414/671 X |
| 4,619,579 | 10/1986 | Frison . | |

FOREIGN PATENT DOCUMENTS

| | | | |
|---|---|---|---|
| 3400916 | 7/1985 | Fed. Rep. of Germany | 414/607 |
| 964161 | 7/1964 | United Kingdom | 414/667 |

OTHER PUBLICATIONS

Cascade Specifications—Cascade Load Pull—Models P4N, P4S, P4Y, P4R.

Cascade Specifications—Cascade Load Push—Models L4N, L4S, L4R.

Long Reach Brochure—Load Push Load Push/Load Pull Attachments (Nov. 1980).

Brochure—Cascade Load Pushes & Load Push/Pulls 9/85.

*Primary Examiner*—Frank E. Werner

*Attorney, Agent, or Firm*—Chernoff, Vilhauer, McClung & Stenzel

[57] ABSTRACT

A push-pull slipsheet handler for a forklift truck is capable of utilizing the truck's standard forks for load-supporting purposes, while enabling mounting and demounting of the push-pull assembly and forks in unison with respect to the lift truck carriage. The upstanding portions of the standard forks are suspended from a transverse mounting member affixed to the frame of the push-pull assembly at an elevated position. The mounting member has a pair of fork-supporting surfaces positioned in transversely offset relation to vertically pivotable push-pull links, thereby minimizing forward protrusion of the push-pull assembly in its fully-retracted position despite the mounting of the standard forks on the push-pull frame. The construction also permits side shifting of the push-pull assembly and standard forks as a unit relative to the lift truck carriage.

6 Claims, 2 Drawing Sheets

PUSH-PULL LOAD HANDLER FOR FORKLIFT TRUCK

BACKGROUND OF THE INVENTION

The present invention relates to forklift truck load push devices and push-pull devices (hereinafter collectively referred to by the term "push-pull"). More particularly, the invention relates to improvements enabling such devices to utilize the standard forks of the lift truck to support the load, and enabling the forks to be mountable and demountable relative to the lift truck carriage in unison with the push-pull device, without necessitating excessive forward protrusion of the push-pull device in its fully-retracted condition.

Previous forklift truck push-pull units fall into several different categories. In one category are standard push-pull attachments such as that shown in Brudi U.S. Pat. No. 3,640,414, or those manufactured by Cascade Corporation of Portland, Oregon under the designations 30C and 45C, or those manufactured by Long Reach Manufacturing Division of Anderson Clayton Company. All of these have push-pull assemblies comprising a frame, a push plate and a push-pull linkage extending therebetween consisting either of horizontally pivotable or vertically pivotable pantographic-type links. Each of these devices also has a transverse member at the bottom of its frame for detachably mounting different types of special-purpose load-supporting members. Because of their attachment to the bottom of the frame, the load-supporting members can be mounted, demounted and side shifted relative to the lift truck carriage in unison with the push-pull assembly However, the expense of such standard push-pull units is relatively high, partially because such units cannot utilize the standard forks of the lift truck to support the load but rather must be provided with their own special loadsupporting members capable of attachment to the transverse member at the bottom of the push-pull frame.

Another category of push-pull slipsheet handlers includes those which are mountable on the lift truck carriage while the standard forks remain mounted on the carriage. Examples of such devices are shown in Anderson, Jr., U.S. Pat. No. 3,885,692, Rocco U.S. Pat. No. 4,065,012, Farmer, et al., U.S. Pat. No. 4,482,286 and Frison U.S. Pat. No. 4,619,579. However, in these structures the forks are not mountable and demountable relative to the lift truck carriage in unison with the push-pull assembly. Nor can the push-pull assembly and forks be shifted transversely in unison relative to the lift truck carriage without the insertion of a side shifter, such as that shown in Kroupa U.S. Pat. No. 3,460,700, between the carriage and the push-pull assembly, which causes the push-pull assembly to protrude forwardly to an excessive degree thereby subtracting from the load-carrying capacity of the counterbalanced lift truck upon which the push-pull assembly is mounted.

A further prior type of push-pull device is that manufactured previously by Cascade Corporation under the designations "Model L4N" and "Model P4N," which utilized the standard forks of the lift truck as the load-supporting members while enabling mounting, demounting, and side shifting of the push-pull assembly and forks in unison relative to the lift truck carriage. The frame of the unit had an elevated transverse member of the general type employed on standard hook-type lift truck carriages from which standard forks could be suspended in a region transversely between the sides of a horizontally pivoting push-pull linkage. However the mounting of the tall, upstanding portions of the standard forks on the push-pull frame between the sides of the linkage limited the extent to which the horizontally pivoting links could be retracted, and therefore caused excessive protrusion of the push-pull assembly in its fully-retracted position thereby subtracting from the load-carrying capacity of the counterbalanced truck upon which the unit was mounted. The unit was eventually discontinued in favor of the aforementioned Cascade 30C and 45C designs which, although incapable of utilizing the standard lift truck forks, avoided the limitation on the retraction of the push-pull assembly previously caused by the upstanding portions of the standard forks.

SUMMARY OF THE INVENTION

The principal object of the present invention is to enable forklift truck push-pull devices to utilize the standard forks of the lift truck to support the load, consistently with enabling the forks to be mountable and demountable relative to the lift truck carriage in unison with the push-pull device without necessitating excessive forward protrusion of the push-pull device in its fully-retracted condition.

It is a further object of the invention to enable the standard forks of the lift truck to be sideshifted in unison with the push-pull device without necessitating excessive forward protrusion of the push-pull device in its fully-retracted condition.

The foregoing objectives are accomplished by equipping the frame of the push-pull assembly with an elevated transverse mounting member capable of detachably supportably engaging the upstanding portions of the standard forks in regions transversely offset relative to vertically-pivotable push-pull links. The transversely-offset relationship of the upstanding portions of the forks, when mounted on the push-pull frame, relative to the push-pull links enables the links when fully retracted to extend substantially vertically in rearwardly-overlapping relation to the upstanding portions of the forks, thereby minimizing the forward protrusion of the push-pull assembly in its retracted condition. Although the push-pull frame's transverse mounting member preferably mounts the upstanding portions of the standard forks in a transversely outward relation to the push-pull links, it is also within the scope of the present invention to enable the forks to be mounted inwardly of the links.

The invention also enables the standard forks to be side-shifted in unison with the push-pull assembly if needed, in which case a side-shifting motor, such as a transversely-extending hydraulic cylinder, is interconnected between the push-pull frame and the forklift truck carriage.

The foregoing and other objectives, features, and advantages of the invention will be more readily understood upon consideration of the following detailed description of the invention, taken in conjunction with the accompanying drawings

DESCRIPTION OF THE PREFERRED EMBODIMENT

Figure 1:
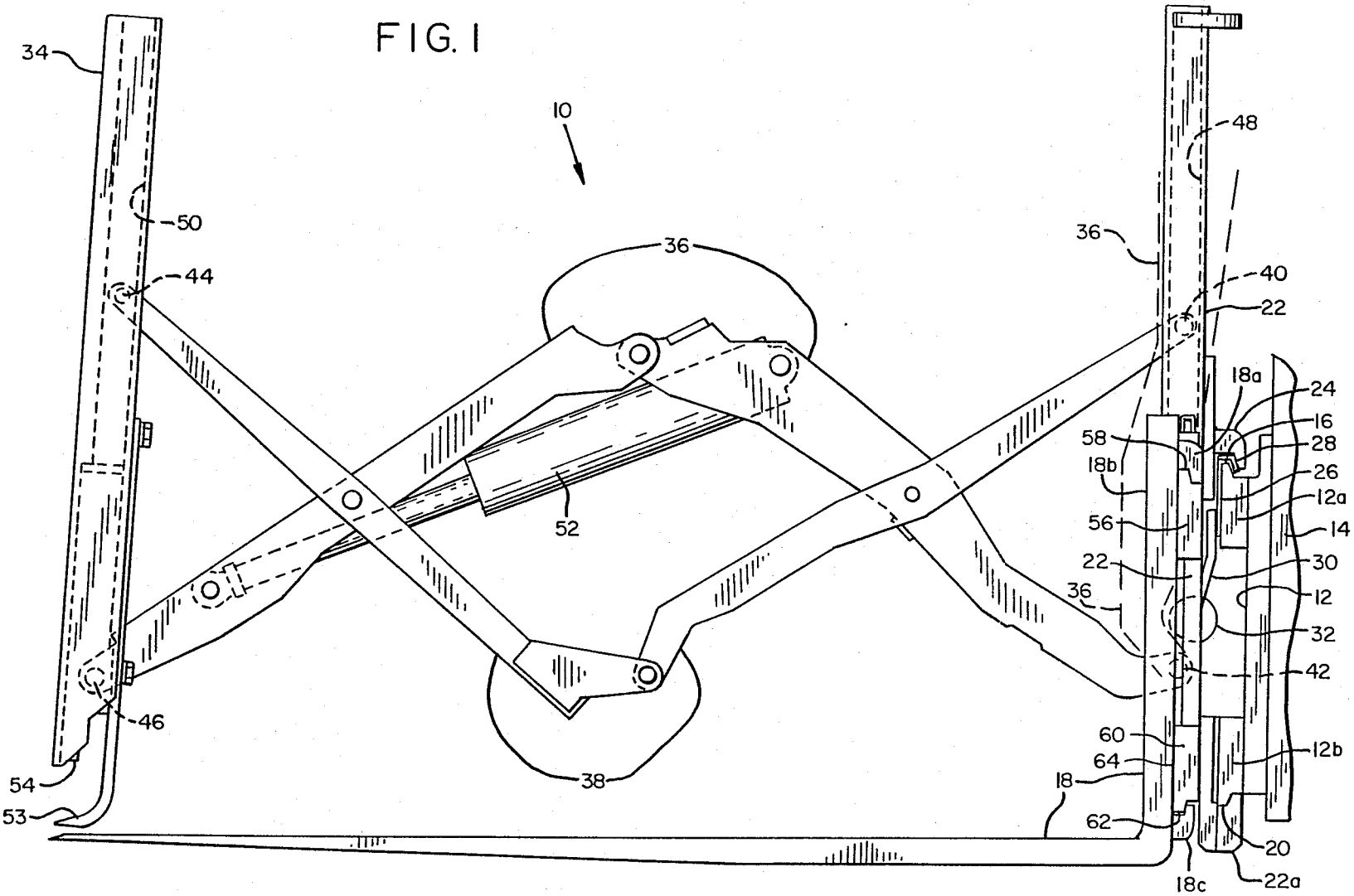
FIG. 1 is a side view of an exemplary push-pull load handler constructed in accordance with the present invention.
Figure 2:
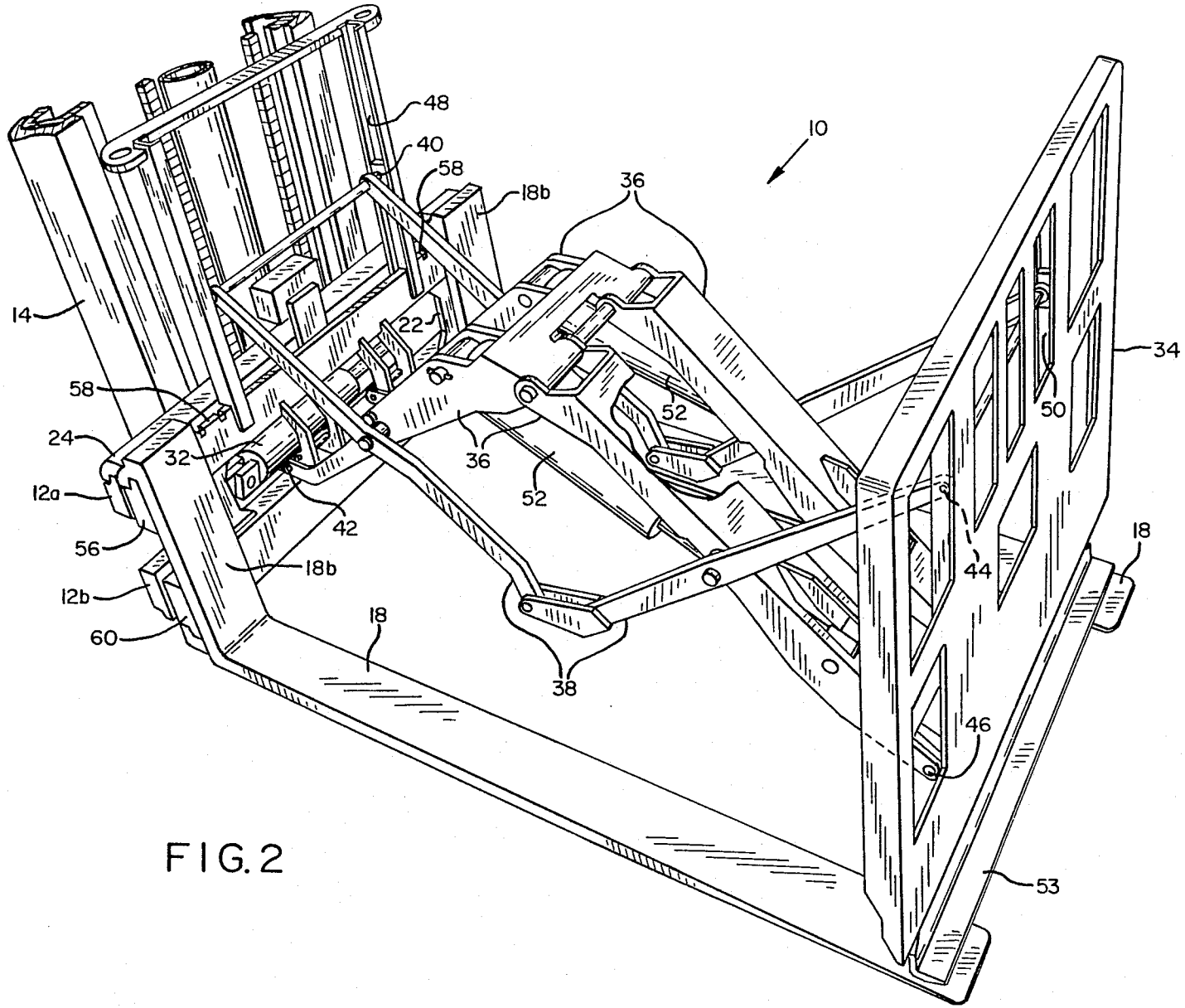
FIG. 2 is a perspective view of the push-pull device of FIG. 1.

The exemplary push-pull device, indicated generally as 10 in the figures, is mounted on a standard hook-type lift truck carriage 12 mounted for vertical reciprocation on a mast 14 at the front of a lift truck. The carriage 12 conventionally has a horizontal, transversely-extending upper fork-mounting member 12*a* at the top of the carriage 12 with an upwardly-facing, lip-type surface 16 which normally, in the absence of the push-pull device 10, supports a pair of standard forks 18 by engagement with a downwardly-opening hook 18*a* at the top of the upstanding portion 18*b* of each fork. The upstanding portion of each fork also has a lower, upwardly-opening hook 18*c* which normally, in the absence of the push-pull device, engages a downwardly-facing, lip-type surface 20 of a lower transversely-extending fork-mounting member 12*b* of the carriage 12. However, as explained hereafter, when the push-pull device 10 is mounted on the lift truck carriage 12, the standard forks 18 are no longer attached to the transverse fork-mounting members 12*a* and 12*b*, respectively.

The push-pull device 10 comprises an upright push-pull frame 22 having a downwardly-opening, elongate, upper engagement hook 24 detachably supported atop the upwardly-facing surface 16 of the carriage upper fork-mounting member 12*a*. If it is not desired that the frame 22 have the ability to shift transversely relative to the lift truck carriage 12, the downwardly-opening hook 24 could directly engage the fork-mounting member 12*a*. However in the embodiment shown in the figures, the push-pull frame 22 can be side-shifted relative to the carriage 12. Accordingly, a conventional quick-mount side-shift bracket 26 and slide bushing 28 are inserted between the fork-mounting member 12*a* and hook 24. The bushing 28 permits transverse sliding of the hook 24, while the bracket 26 provides an anchor 30 for one end of a hydraulic side-shifting cylinder and piston assembly 32, the opposite end of which is connected to the push-pull frame 22 to selectively shift the push-pull frame transversely with respect to the carriage 12 when actuated.

Mounted on the push-pull frame 22 is a powered linkage for selectively extending and retracting a push-plate 34 relative to the frame 22. The linkage comprises two transversely-spaced linkage assemblies, each consisting of a pair of hinged links 36 and a pair of hinged links 38 connected to the frame 22 at respective horizontal, transversely-extending pivot axes 40, 42 and to the push-pull plate at respective horizontal, transversely-extending pivot axes 44 and 46. The upper pivot axes 40 and 44 are vertically slidable in upstanding channels 48 and 50 carried by the frame 22 and plate 34, respectively. A selectively-actuated cylinder and piston assembly 52 on each of the transversely-spaced linkage assemblies controls the retraction and extension of the linkage and thus of the push-plate 34. If load pulling, as well as load-pushing, capability is desired, the push-plate 34 is provided with a conventional slipsheet clamp comprising a lower jaw 53, and an upper jaw 54 vertically movable relative to the jaw 53 for selectively clamping a slipsheet therebetween and pulling the slipsheet and its load onto the forks 18.

In order to enable the push-pull device 10 to utilize the standard load-supporting forks 18 of the lift truck as the load-supporting members of the push-pull device while, at the same time, enabling the forks 18 to be mountable, demountable, and preferably sideshiftable in unison with the push-pull frame 22 relative to the lift truck carriage 12, the push-pull frame 22 has an elevated transverse mounting member 56 affixed thereto having respective upwardly-facing, lip-type surfaces 58 located adjacent to and forwardly of the downwardly-facing surface of the hook 24 and positioned in transversely offset, outward relation to the respective pairs of links 36 and 38. The mounting member 56 and its upwardly-facing surfaces 58 are similar to the mounting member 12*a* of the carriage 12 and its upwardly-facing surface 16 so as to be capable of detachably engaging the hooks 18*a* of the standard forks 18 to vertically support them. Near the bottom extremity 22*a* of the push-pull frame 22, a further transverse mounting member 60 is affixed to the frame 22 having a similar downwardly-protruding lip-type surface 62 for engaging the lower hook 18*c* of each fork, and defining a pair of forwardly-facing, transversely and vertically-extending surfaces 64 likewise positioned in transversely offset relation to the links 36 and 38. The surfaces 64 are directly below, and substantially coextensive in a forward direction with, the upwardly-facing surfaces 58 of the upper transverse mounting member 56, and thus provide a forwardly-facing bearing surface for engaging the upstanding portions of the forks to oppose the downward moment of the load. It is not necessary that the upwardly-facing surfaces 58 of the transverse mounting member 56 be exactly at the same elevation as the downwardly-facing surface of the engagement hook 24, but they must be vertically nearer thereto than to the bottom extremity 22*a* of the push-pull frame 22.

The transversely offset relation of the upwardly-facing surfaces 58 and forwardly-facing surfaces 64 relative to the push-pull links 36 and 38 causes the upstanding portions 18*b* of the respective forks likewise to be transversely offset with respect to the links 36 and 38. This enables the rearward links 36 and 38, when fully retracting the push-plate, to extend substantially vertically in rearwardly-overlapping relation to the upstanding portions 18*b* of the forks as exemplified by the link 36 shown in phantom in FIG. 1. This in turn minimizes the forward protrusion of the push-pull assembly in its fully-retracted position, thereby overcoming the previous problem of diminished load-carrying capacity caused by previous attempts to mount standard lift truck forks on the push-pull frame for movement in unison therewith.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A push-pull device adapted for mounting on a vertically-movable forklift truck carriage having a horizontal, transversely-extending fork-mounting member at the top of said carriage with an upwardly-facing surface for detachably supporting transversely-spaced forks having elongate upstanding portions and elongate load-supporting portions extending forwardly from the bottoms of said upstanding portions, said push-pull device comprising:

(a) a push-pull assembly including an upright frame, a push plate, and powered means mounted on said frame for selectively extending and retracting said push plate with respect to said frame, said powered means comprising elongate, forwardly-extending links pivotally connected to said frame and said push plate, respectively, for pivoting with respect to each of said frame and push plate about respective horizontal, transversely-extending, vertically-spaced upper and lower pivot axes said upper and lower axes of pivoting with respect to said frame being located in a substantially vertical plane;

(b) engagement means on said frame having a downwardly-facing surface for detachably supportably resting atop said upwardly-facing surface of said forkmounting member; and (c) transverse mounting means affixed to said frame, having resepective fork-supporting upwardly-facing surfaces adjacent to and forwardly of said downwardly-facing surface of said engagement means, said upwardly-facing surfaces being positioned vertically above the lower pivot axis and below the upper pivot axis about which said links pivot with respect to said frame and being located substantially in said plane, for detachably engaging said upstanding portions of said forks and thereby supporting said upstanding portions vertically on said frame in transversely offset relation to said links.

2. The apparatus of claim 1 wherein said frame has a bottom extremity and wherein said upwardlyfacing surfaces of said transverse mounting means on said frame are positioned vertically nearer to said downwardly-facing surface of said engagement means than to said bottom extremity of said frame.

3. The apparatus of claim 2 wherein said frame includes means defining a pair of forwardlyfacing, transversely and vertically-extending surfaces adjacent to said bottom extremity of said frame and positioned in transversely offset relation to said links directly below, and substantially coextensive in a forward direction with, said respective upwardly-facing surfaces of said transverse mounting means.

4. The apparatus of claim 1 wherein said respective upwardly-facing surfaces of said transverse mounting means are positioned transversely outwardly of, and on opposite sides of, said links.

5. The apparatus of claim 1, further including means mounted on said frame for selectively moving said frame and said forks in unison transversely with respect to said forklift truck carriage.

6. The apparatus of claim 1 wherein said forks are mounted on said transverse mounting means of said frame with the upstanding portions of said forks supported by said upwardly-facing surfaces of said transverse mounting means, at least a portion of said links, when fully retracting said push plate, occupying a position transversely offset from, and in rearwardly overlapping and vertically overlapping relation to, said upstanding portions of said forks.

* * * * *